US006412614B1

(12) United States Patent
Lagrange et al.

(10) Patent No.: US 6,412,614 B1
(45) Date of Patent: Jul. 2, 2002

(54) DOWNHOLE SHOCK ABSORBER

(75) Inventors: Timothy Edward Lagrange, Penhold; Andrew Antoine Buzinsky; David O. Carlson, both of Sherwood Park, all of (CA)

(73) Assignees: Core Laboratories Canada Ltd.; Computalog Ltd., both of Calgary (CA)

( * ) Notice: Subject to any disclaimer, the term of this patent is extended or adjusted under 35 U.S.C. 154(b) by 0 days.

(21) Appl. No.: 09/399,093

(22) Filed: Sep. 20, 1999

(51) Int. Cl.[7] ..... E21B 4/06

(52) U.S. Cl. ..... 188/281; 188/275; 188/313; 267/136; 175/293

(58) Field of Search ..... 188/284, 313, 188/316, 322.15, 275, 281, 282.1, 282.7, 282.8, 282.9; 175/293

(56) References Cited

U.S. PATENT DOCUMENTS

| | | | | | |
|---|---|---|---|---|---|
| 2,387,266 | A | * | 10/1945 | Holland | 267/3 |
| 2,410,992 | A | * | 11/1946 | Myklestad | 188/88 |
| 2,905,458 | A | * | 9/1959 | Mason | 267/1 |
| 3,871,193 | A | * | 3/1975 | Young | 64/23 |
| 3,941,190 | A | * | 3/1976 | Conover | 166/187 |
| 4,036,335 | A | * | 7/1977 | Thompson et al. | 188/319 |
| 4,128,149 | A | * | 12/1978 | Leppich | 188/322 |
| 4,186,569 | A | * | 2/1979 | Aumann | 64/23 |
| 4,194,582 | A | * | 3/1980 | Ostertag | 175/321 |
| 4,203,507 | A | * | 5/1980 | Tomita et al. | 188/317 |
| 4,246,765 | A | * | 1/1981 | Zabcik | 64/23 |
| 4,305,486 | A | * | 12/1981 | Cowan | 188/319 |
| 4,388,973 | A | * | 6/1983 | Winkelmann et al. | 175/321 |
| 4,423,800 | A | * | 1/1984 | Kobiske et al. | 188/277 |
| 4,456,233 | A | * | 6/1984 | Muller | 267/70 |
| 4,779,852 | A | * | 10/1988 | Wassell | 267/125 |
| 4,817,710 | A | | 4/1989 | Edward et al. | |
| 4,826,094 | A | * | 5/1989 | Whiteley | 242/18 DD |
| 4,844,181 | A | * | 7/1989 | Bassinger | 175/195 |
| 4,932,471 | A | | 6/1990 | Tucker et al. | |
| 5,083,623 | A | | 1/1992 | Barrington | |
| 5,117,911 | A | | 6/1992 | Navarette et al. | |
| 5,133,419 | A | | 7/1992 | Barrington | |
| 5,188,191 | A | | 2/1993 | Tomer | |
| 5,778,987 | A | * | 7/1998 | Baiden et al. | 173/19 |
| 5,968,102 | A | * | 10/1999 | Ichimaru et al. | 701/37 |
| 6,244,577 | B1 | * | 6/2001 | Bucholtz | 267/136 |

FOREIGN PATENT DOCUMENTS

| | | | |
|---|---|---|---|
| JP | 392634 | * | 4/1991 |
| JP | 9309313 A | * | 12/1997 |

OTHER PUBLICATIONS

Owen Oil Tools Inc 1997 Catalog 3½ Vertical Shock Absorber Owen Oil Tools Inc, Ft Worth TX 1997.

Halliburton Energy Services Inc. 1998 Catalog Vertical Shock Absorber.

* cited by examiner

*Primary Examiner*—Paul N. Dickson
*Assistant Examiner*—Melody M. Burch
(74) *Attorney, Agent, or Firm*—Bennett Jones LLP

(57) ABSTRACT

A shock absorber for damping shock energy generated by downhole perforating guns or stimulation devices is described. The shock absorber includes a spring assembly including at least a first spring and a second spring, the first spring having a tension greater than the second spring; a damper assembly; and a housing retaining the spring assembly and the damper assembly and including ends adapted for connection into a casing perforation assembly. The provision of springs of increasing stiffness permits the force generated by the perforating gun to be absorbed gradually and smoothly.

3 Claims, 7 Drawing Sheets

DOWNHOLE SHOCK ABSORBER

FIELD OF THE INVENTION

The invention relates generally to shock absorbers for the insertion in a drill, tubing, or wireline string to isolate downhole explosive apparatus from other downhole tools. In particular, the invention relates to a shock absorber for isolating the jarring effect of perforating guns and high-energy gas stimulation systems from delicate instrumentation or other downhole equipment that may be prone to mechanical damage from perforating gun detonation.

BACKGROUND OF THE INVENTION

During oil or gas well completion operations, it is necessary to perforate the casing to provide communication between the hydrocarbon bearing formations and the wellbore, so that the hydrocarbons may be produced to the surface. The casing perforation operation is carried out using explosive shaped charges, which blast holes in the casing and its surrounding cement sheath to access the hydrocarbon bearing formation.

It is becoming common to place instrumentation packages in close proximity to the perforating guns. These instruments measure downhole pressures to provide an indication of the influx rate, pressure, or temperature of the wellbore to give an indication of the success of the perforations and the production rate of the well. The firing of the perforating guns or stimulation devices produces large shock waves, which exert huge forces upon the instrumentation or other downhole equipment, often causing their failure. A shock absorber, when positioned between the perforating gun and the downhole equipment, considerably reduces the forces upon the equipment and expands their operating range and useful lifetime. Shock absorbers also permit the deployment of certain other tools that otherwise may not be operated in conjunction with perforating systems.

Some prior art shock absorbers rely on elastomeric elements, formed of rubber for example, to absorb shock waves. However, the effectiveness of an elastomeric element is limited due to the limited range of motion of the element and its inherent damping characteristics. A typical elastomeric element might be able to withstand 0.5" of travel, which is generally ineffective for use with perforating systems. Other shock absorbers have used spring and damper arrangements including compressible oil. Compressible oil is very expensive and transmits large loads to the instrumentation due to the high loading required to begin compression of the fluid and springs. The need exists for a shock absorber that is more effective and less expensive than those already in use.

SUMMARY OF THE INVENTION

A shock absorber for damping shock energy generated by downhole perforating guns or stimulation devices has been invented and is disclosed herein. The invention provides an apparatus for conducting downhole measurements while perforating wherein the impulsive energy of the perforating guns is absorbed and, thereby, shielded from the downhole measurement tools.

In accordance with a broad aspect of the present invention, there is provided a shock absorber for absorbing the energy generated by a perforating gun, comprising a spring assembly including at least a first spring and a second spring, the first spring having a tension greater than the second spring; a damper assembly; and a housing retaining the spring assembly and the damper assembly and including ends adapted for connection into a casing perforation assembly.

The shock absorber according to the present invention includes ends formed for attaching into a casing perforation assembly, the assembly including a perforation gun and a downhole tool desired to be shielded from the force exerted by the perforation gun during detonation such as, for example, a gauge recorder. Preferably the ends of the shock absorber are formed for threaded engagement into the perforation assembly. The shock absorber housing preferably includes two telescopically disposed parts between which the spring assembly and the damper assembly act.

The spring assembly is the primary mechanism for absorbing and dissipating the shock loading from the perforating guns. The shock absorber is designed to be double acting, so that the shock impulse can be applied from either direction and be absorbed and dissipated, without the need for a set of springs to handle impulse from each direction. The shock absorber includes a plurality of springs preferably of various stiffnesses, so as to give multiple discrete spring rates. In one embodiment, a plurality of springs are used, each of which is progressively stiffer and serves to gently absorb the shock wave. In a preferred embodiment some of the springs can be removed or further springs can be added to change the preload of the spring assembly. Changing the preload of the spring assembly provides that the shock absorber can be adjusted with consideration as to the downhole tools that are to be hung from the shock absorber. In this embodiment, the preload of the shock absorber can be adjusted to be in the neutral position when the downhole tools such as, for example, a gauge recorder, are hung from the shock absorber. The selection of preload allows maximum stroke and energy absorption from the shock absorber in service. In the preferred embodiment, the spring rates are fairly low so that the shock absorber can absorb most of the shock while the tools hung below the absorber remain relatively stationary during the detonation of the guns.

The damper assembly has a plurality of oil filled chambers and a valve mechanism to regulate the flow of oil from a first chamber to a second chamber. The oil is preferably substantially non-compressible to reduce the cost of the shock absorber over a shock absorber requiring compressible oil. Preferably, the first chamber includes a piston that is moveable to reduce the volume of the first chamber in response to a loading, such as that applied by the detonation of a perforating gun. When the piston reduces the volume, oil will be forced from the first chamber into the second chamber. In one embodiment, the chamber is selected such that its volume will only be reduced by a load over a selected level. In one embodiment, the damper valve mechanism includes a metering mechanism to restrict the flow of oil from one chamber to another in response to the loading. The damper assembly can be hollow, having a bore therethrough for permitting passage of a member such as, for example, a conductor (i.e. wireline) or full tubing bore therethrough and, thereby, through the centre of the shock absorber.

It is an object of the present invention to provide a mechanism for protecting the very delicate instrumentation, such as pressure recording gauges, when the perforating guns are detonated. It is a further object of the invention to provide a shock absorber that is capable of very rapid displacement and subsequent shock absorption and dissipation.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE DRAWINGS

Figure 1A:
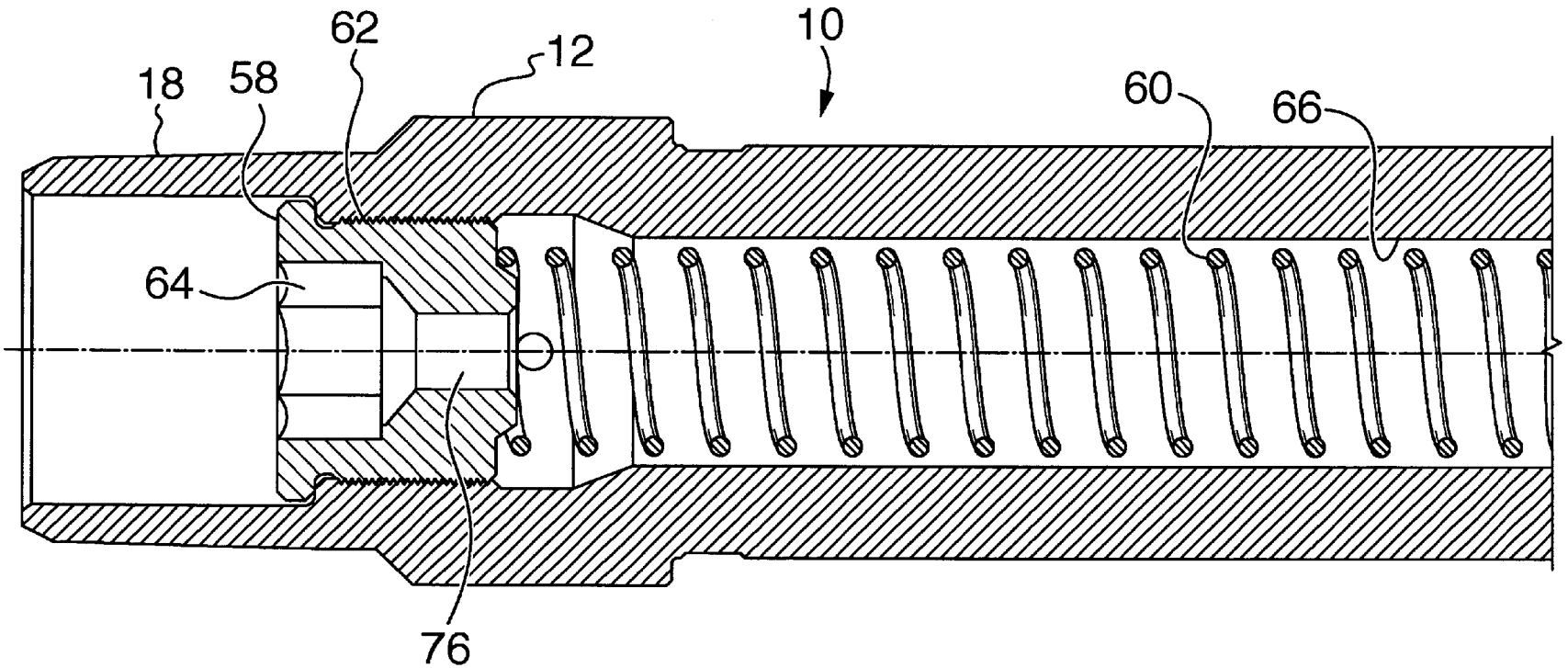
FIGS. 1A to 1E are together a section through a shock absorber according to the present invention in a neutral or rest position.
Figure 1B:
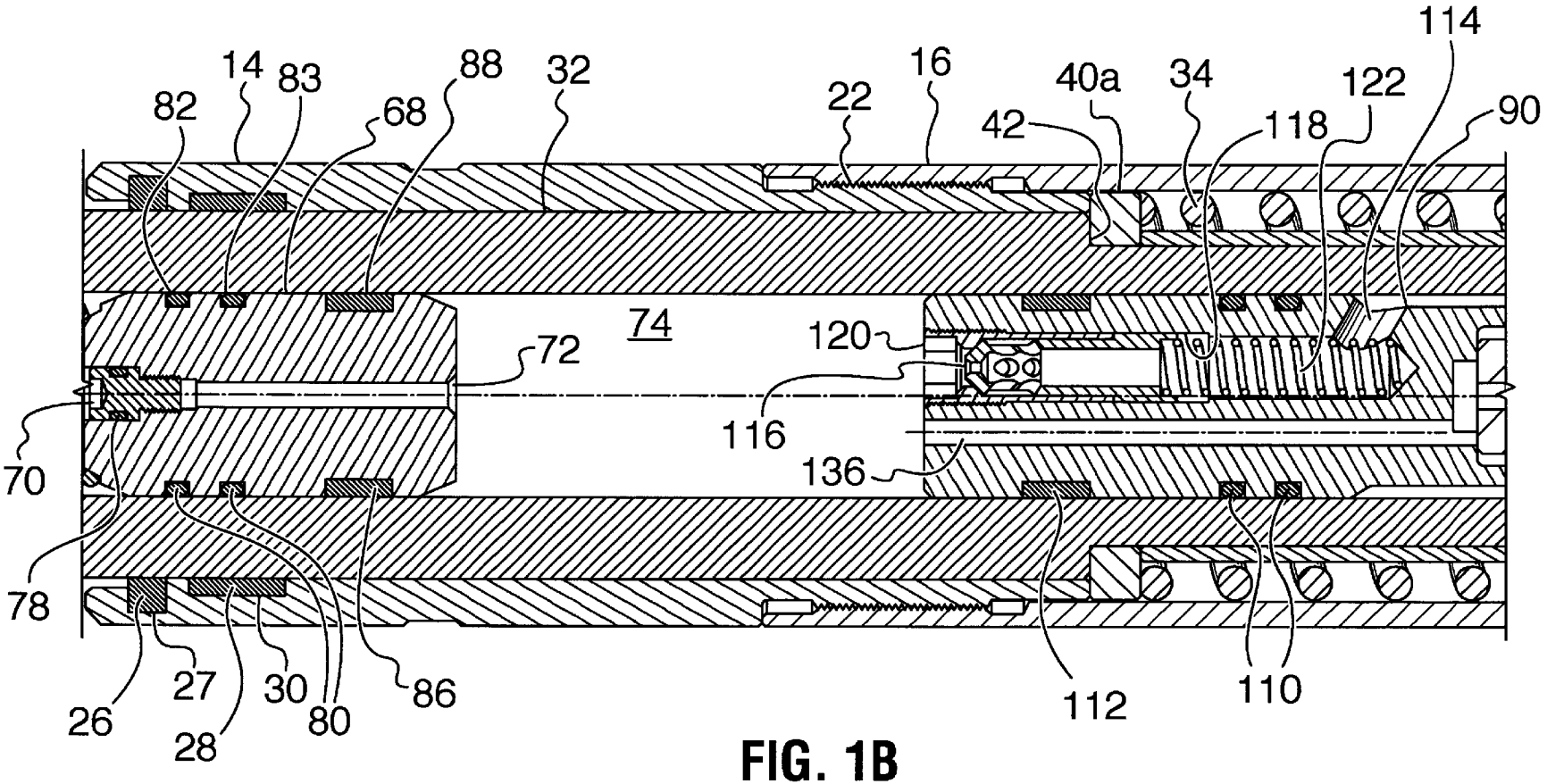
Figure 1C:
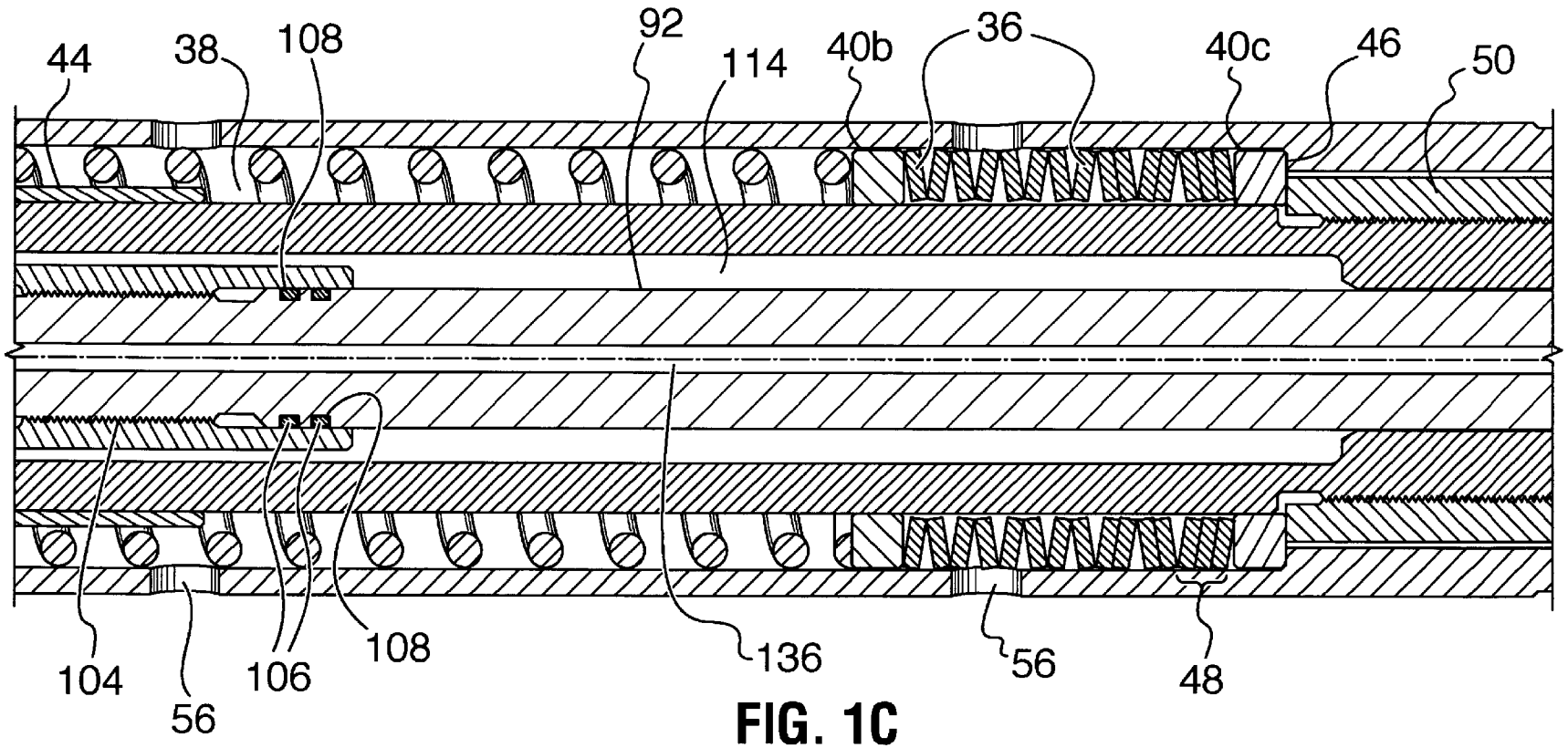
Figure 1D:
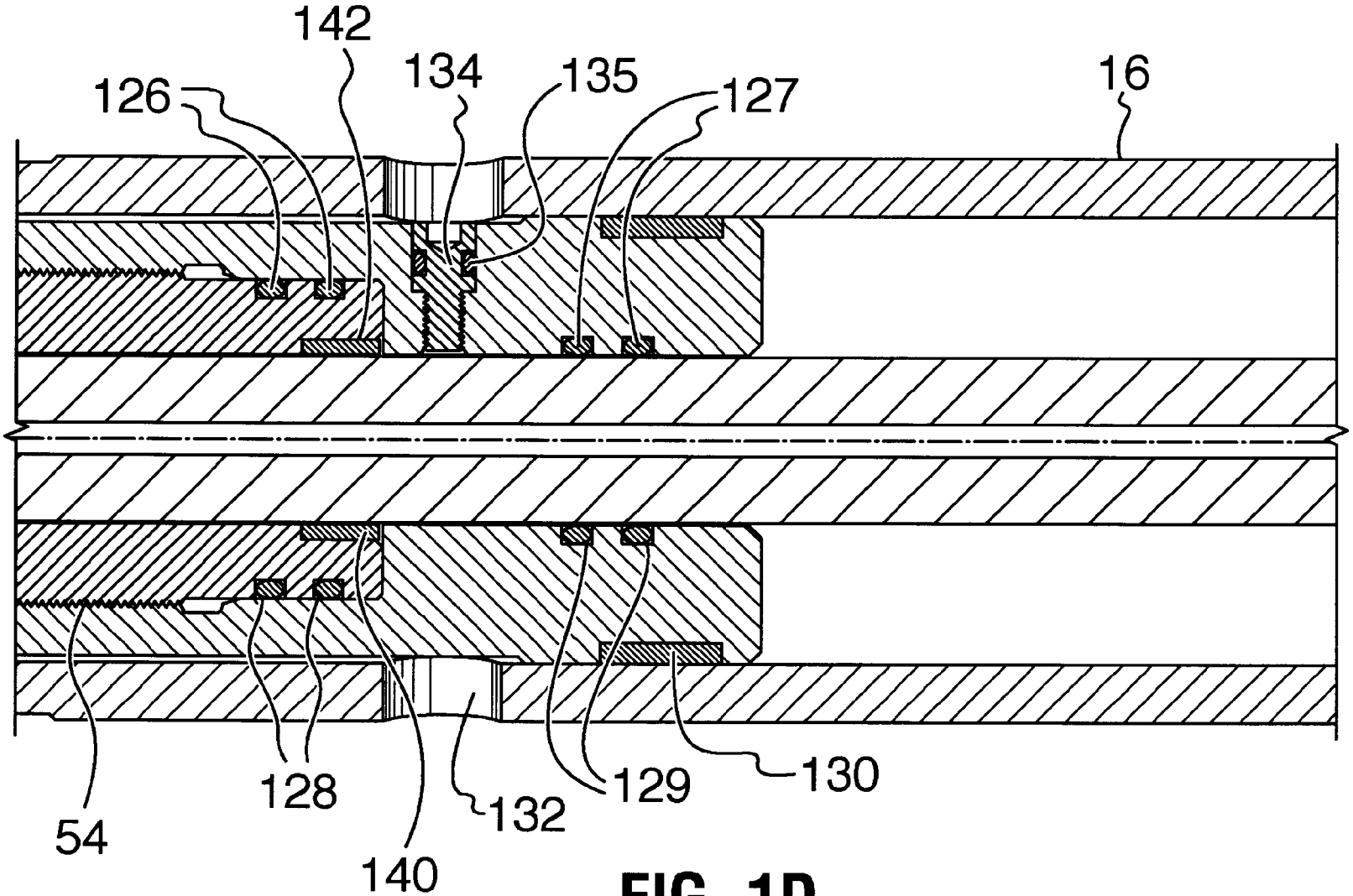
Figure 1E:
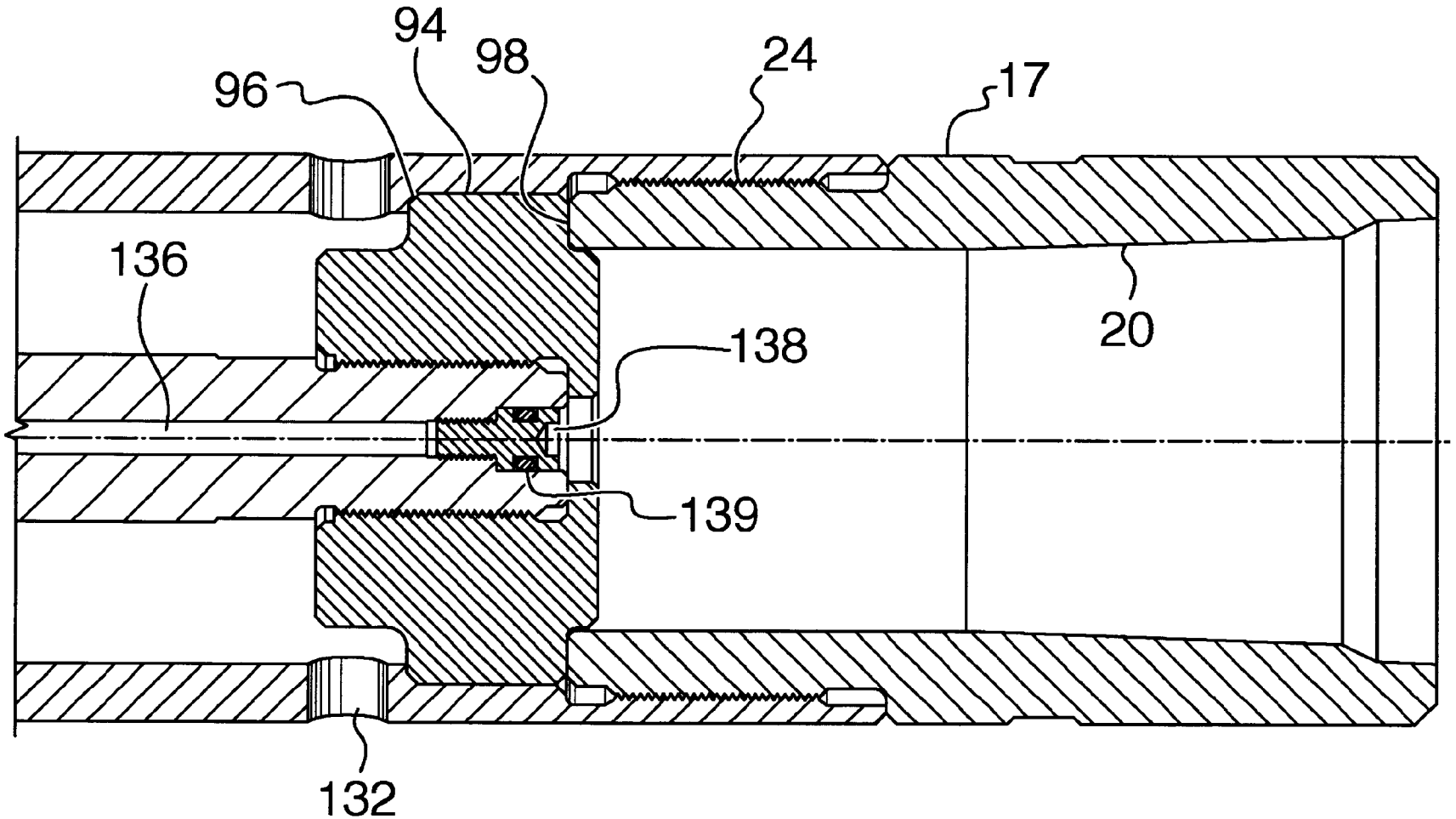
Figure 2:
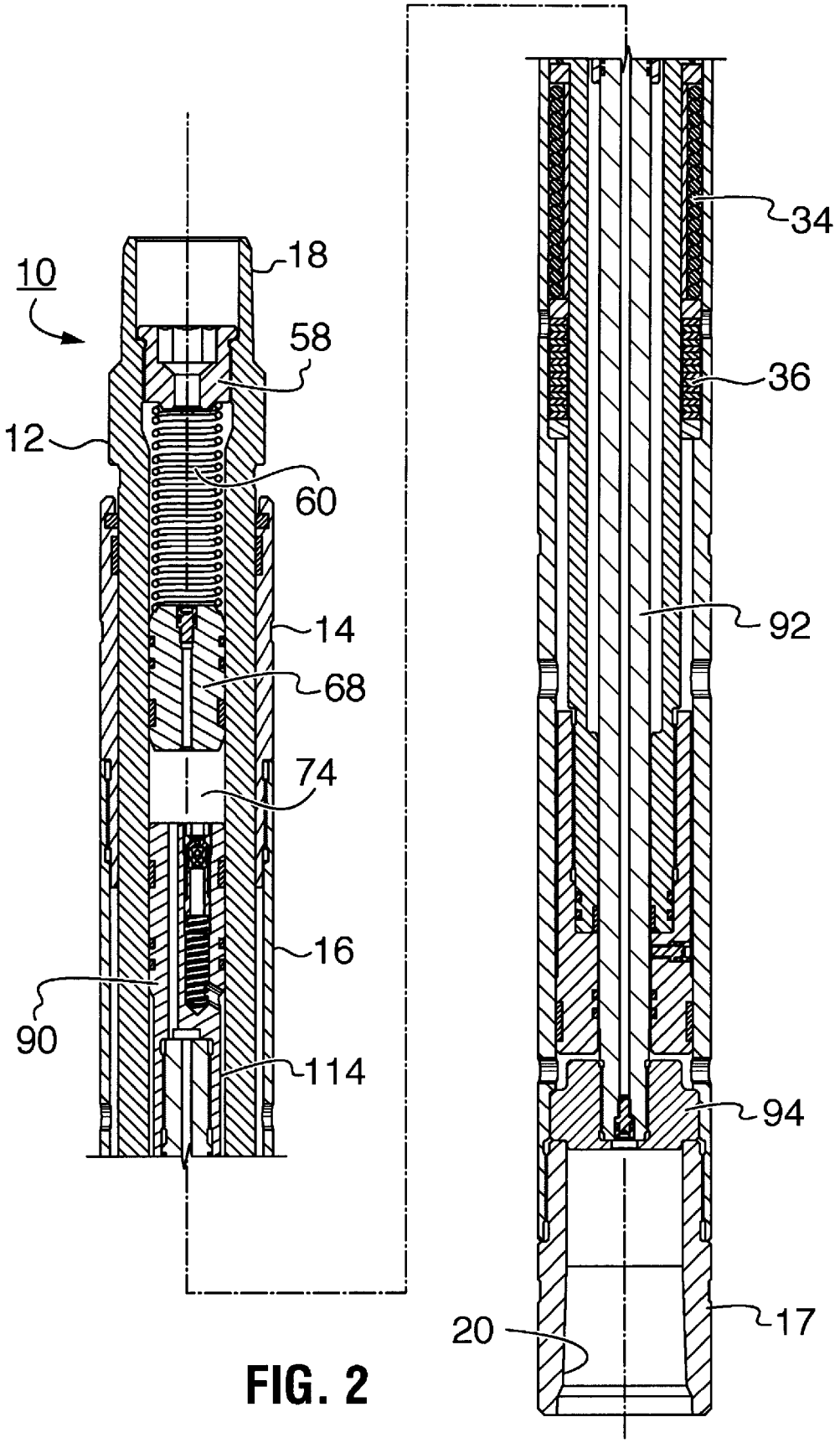
FIG. 2 is a section through the shock absorber of FIGS. 1A to 1E in a compressed position.
Figure 3:
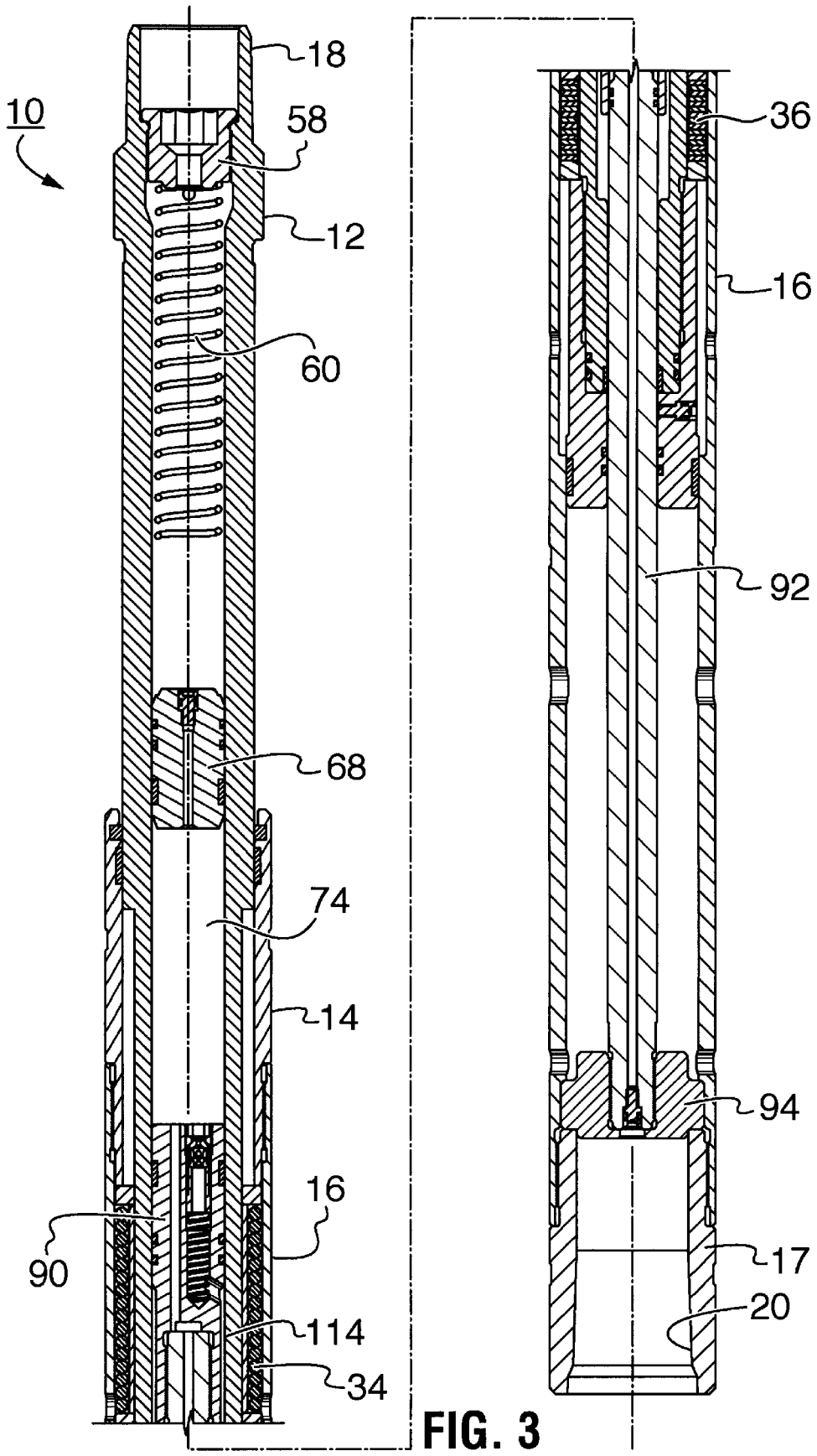
FIG. 3 is a section through the shock absorber of FIGS. 1A to 1E in an extended position.

FIGS. 1–3 show a shock absorber 10 according to the present invention. Shock absorber 10 includes a shock mandrel 12, illustrated herein as the upper end, telescopically disposed and moveable within a tube formed from an upper cap 14, a spring housing 16 and a bottom connector 17. Shock absorber 10 is selected to be disposed in the perforation assembly between a perforation gun (not shown) and a downhole tool (not shown). The shock absorber acts to shield the downhole tool from a shock wave passing through the assembly and generated by the detonation of the gun. The shock absorber can be positioned above or below the perforation gun depending on the location of the downhole tool.

The upper end of the shock mandrel 12 has threads 18 for connection to a tubing string or wireline, while the connection to the perforation guns or other downhole equipment is made through threads 20 on bottom connector 17. Upper cap 14, spring housing 16 and bottom connector 17 are connected by threads 22 and 24.

Upper cap 14 carries a wiper ring 26 in gland 27 and a wear ring 28 in gland 30. Rings 26, 28 form a seal between the upper cap and the mandrel and clean the outer surface of mandrel 12 as it slides in bore 32 of upper cap 14.

Spring housing 16 surrounds a spring 34 and a plurality of Belleville springs 36. Spring 34 is a compression-type coil spring and is retained in a spring chamber 38 between housing 16 and shock mandrel 12. Spring 34 is biased between spring spacer 40*a* and spring spacer 40*b*. Spring spacer 40*a* abuts the lower end of upper cap 14, and a shoulder 42 machined on shock mandrel 12. Spring spacer 40*b* is free to move axially within spring chamber 38. A spring sleeve 44 is disposed in chamber 38 to limit the extent to which spring spacer 40*b* can move toward spring spacer 40*a* and, thereby, to limit the compression of spring 34. Belleville springs 36 act against the opposite side of spring spacer 40*b*. The Belleville springs are stacked in three different configurations, so as to give different spring rates and to absorb the shock waves progressively. Abutting the Belleville spring stack at their end opposite spacer 40*b* is another spring spacer 40*c*, which transfers the spring loads to shoulder 46 in spring housing 16. Spring 34 is preferably selected to have a stiffness less than that of any of the Belleville washer configurations, such that when a force is applied to the shock absorber, spring 34 will compress first followed by the least stiff configuration of Belleville springs and then the next stiff configuration of Belleville springs and finally the most stiff configuration of Belleville springs (i.e. the stack of Belleville springs all oriented in the same direction, identified as 48). The provision of springs of increasing stiffness permits the force to be absorbed gradually and smoothly.

Spring spacer 40*c* also abuts against an end of a lower mandrel body 50, which is rigidly attached to the lower end of the shock mandrel 12 by means of threads 54. As such, lower mandrel body 50 moves with shock mandrel 12. Spring 34 and Belleville springs 36 are therefore compressed between shock mandrel 12, upper cap 14, spring housing 16 and lower mandrel body 50. Since spring 34 and Belleville springs 36 can be acted upon by any of shoulder 42, upper cap 14, shoulder 46 or lower mandrel body 50, the shock absorber is double acting and functional against shock inputs from either end.

Holes 56 in the spring housing ensure that the mandrel can move freely within the housing. There will not be a trapped air or fluid pocket around the spring 34 that will impede its movement.

The shock absorber of the present invention also includes a damper assembly. In the illustrated embodiment shock mandrel 12 includes a mandrel plug 58 which acts as a retainer for a spring 60. Mandrel plug 58 engages mandrel 12 through threads 62 and includes a hex 64, which facilitates use of a hex key to install or remove plug 58.

Shock mandrel 12 has a central axial bore 66 in which a balance piston 68 slides. Spring 60 acts between mandrel plug 58 and balance piston 68 to dampen the action of the balance piston and to bias it towards a selected neutral position. Balance piston 68 incorporates an oil filler plug 70 in a central passage 72 to allow for filling upper oil chamber 74 with oil. Mandrel plug 58 has a central passage 76 through which filler plug 70 can be accessed. Filler plug 70 also retains an O-ring 78 thereabout which provides a seal between the filler plug and central passage 72.

Balance piston 68 also includes O-rings 80 in glands 82, 83 that seal between the piston and bore 66 of shock mandrel 12. A wear ring 86 in gland 88 functions to centralise balance piston 68 and to provide a low friction surface facilitating the sliding of the balance piston within the bore.

Extending into bore 66 of shock mandrel 12 is piston 90 which is connected, through piston rod 92 and piston retainer 94, to move with the tube formed from upper cap 14, spring housing 16, and bottom connector 17. In the illustrated embodiment, piston retainer 94 is secured in position by machined shoulder 96 and abuts the top land 98 of bottom connector 17.

Piston 90 is attached and sealed to piston rod 92 by threads 104 and O-rings 106 disposed in glands 108. Piston 90 seals to the bore 66 of shock mandrel 12 through O-rings 110, and is centralised in the bore by a wear ring 112. The wear ring also provides a low friction surface between mandrel 12 and piston 90.

Piston 90 moves within bore 66 to effect the volume of upper oil chamber 74 and a lower oil chamber 114 on the opposite side of the piston. Piston 90 includes a valve mechanism 116 for permitting the flow of oil in a regulated manner between chamber 74 and chamber 114. Valve mechanism 116 is disposed in a bore 118 through piston 90. The valve mechanism includes a poppet case 120 and a balance spring 122 in bore 118. Balance spring 122 forces the valve mechanism 116 into the poppet case. Therefore there is a reduced metering effect, due to the greater exposed area when the shock absorber is being compressed, than when it is being extended. This gives a greater damping effect when the shock absorber is being extended.

Chamber 114 is sealed by O-rings 110 as well as by O-rings 126 and 127 in glands 128 and 129, respectively. O-rings 126 are carried by lower mandrel body 50 to provide a seal between it and piston rod 92. Lower mandrel body 50 also contains a wear ring 130 to centralize body 50 within spring housing 16. Holes 132 in the spring housing permit movement of lower mandrel body 50 within the spring housing and permit access to another filler plug 134. Filler plug 134 is similar to filler plug 70 and has thereabout an O-ring 135 Filler plug 134 permits the shock absorber to be filled with oil and/or air to vent from the shock absorber if oil is being passed through another filler plug.

Extending through piston 90 and piston rod 92 is a passage 136 through which oil can be passed to fill chambers 74 and 114 in preparation for use of the shock absorber. A filler plug 138, similar to filler plug 70, and O-ring 139 is disposed in passage 136.

The lower end of shock mandrel 12 incorporates a wear ring 140 in gland 142 to guide and centralise piston rod 92.

The shock absorber acts to absorb forces applied at either end thereof to prevent the force from being transmitted therealong. As an example, when a force is applied against shock mandrel 12 which would tend to drive it into the bore formed from upper cap 14 and spring housing 16, shoulder 42 is driven against spring spacer 40*a*. This causes spacer 40*a* to be driven toward spring spacer 40*b*. Since spring 34 has a lesser tension than any of the configurations of Belleville springs 36, spring 34 is compressed between spacers 40*a* and 40*b*. This compression will continue until the force is absorbed or until the compression is limited by spring sleeve 44. If there is force in excess of the absorption capacity of spring 34, this force will then be applied through spring spacer 40*b* to the Belleville springs. The Belleville spring configurations will then compress in turn, as necessary depending on their stiffness, to absorb the force. The force will be absorbed gradually through the coil and Belleville spring configurations, in order as determined by their degree of stiffness. The spring with the greatest stiffness (i.e. a stack of Belleville springs oriented in the same direction) will compress last.

As the springs are being compressed, shock mandrel 12 moves axially into spring housing 16. As a result, piston 90 is advanced into bore 66 toward mandrel plug 58. As piston 90 advances, balance piston 68 is driven against the tension in spring 60. Simultaneously, the volume of chamber 114 increases, thus drawing oil through the valve mechanism 116 and thereby reducing the volume of chamber 74. The spring 60 also assists in forcing oil through valve mechanism 116 by applying force to balance piston 68 as the spring 60 compresses. During advancement of the piston 90 into bore 66 toward mandrel plug 58, the valve mechanism is forced away from the poppet case to minimise the metering effect. When the force is fully absorbed by the springs, or when the shock absorber is fully compressed the spring 34 and the Belleville springs 36 will begin to recover and force the shock absorber to approach the neutral position. Since the valve mechanism serves to regulate the flow of oil back into chamber 74, the recovery of the springs will be controlled and slowed and any oscillations will be damped. As will be appreciated, to properly operate the oil is preferably substantially non-compressible.

Depending upon the intensity of shock energy applied to the shock absorber, the shock absorber may cycle through the compressed and extended positions several times to dissipate the shock energy and reach the neutral position.

In preliminary testing, the shock absorber was able to reduce the acceleration forces exerted upon an instrument pack by a factor of 20, when compared to the acceleration forces generated through the same casing perforation assembly without a shock absorber.

While the invention has been described or shown in only some of its forms, it should be apparent to those skilled in the art that it is not so limited, but is susceptible to various changes without departing from the scope of the invention.

What is claimed is:

1. A shock absorber for absorbing the energy generated by a downhole shock generating device, comprising: a housing tube; a shock mandrel telescopically disposed within the housing tube; a spring assembly disposed between the housing tube and the shock mandrel to resist axial movement of the shock mandrel within the housing tube, the spring assembly including at least a first spring and a second spring, the first spring having a stiffness greater than the second spring, the first and second springs being contained between first and second shoulders on the shock mandrel and between first and second shoulders on the housing tube and compressible by any one of the shoulders; a damper assembly to dampen axial movement of the shock mandrel within the housing tube, the damper assembly includes a valve permitting two way flow of fluid therethrough but providing a greater dampening effect against axial movement of the shock mandrel out of the housing tube than that against axial movement of the shock mandrel into the housing tube; an end of the shock mandrel extending at the first end of the shock absorber and adapted for connection into a downhole assembly; and an end of the housing tube extending at the opposite end of the shock absorber and adapted for connection into the downhole assembly.

2. The shock absorber of claim 1, wherein the valve is a poppet valve.

3. The shock absorber of claim 1, wherein the damper assembly includes a balance piston open on one side thereof to fluid pressure external to the shock absorber.

* * * * *